US008074712B2

(12) United States Patent
Olsen et al.

(10) Patent No.: US 8,074,712 B2
(45) Date of Patent: Dec. 13, 2011

(54) STOP COLLAR FRICTION CLAMPING DEVICE

(75) Inventors: Shawn A. Olsen, Spring, TX (US); Roger R. Steinsiek, Houston, TX (US); James C. Hunziker, New Caney, TX (US)

(73) Assignee: Baker Hughes Incorporated, Houston, TX (US)

( * ) Notice: Subject to any disclaimer, the term of this patent is extended or adjusted under 35 U.S.C. 154(b) by 209 days.

(21) Appl. No.: 12/423,540

(22) Filed: Apr. 14, 2009

(65) Prior Publication Data

US 2009/0255666 A1 Oct. 15, 2009

Related U.S. Application Data

(60) Provisional application No. 61/044,559, filed on Apr. 14, 2008.

(51) Int. Cl.
*E21B 17/10* (2006.01)

(52) U.S. Cl. ..... 166/241.6; 166/241.1; 175/325.1; 175/325.5

(58) Field of Classification Search .... 166/241.2–241.4, 166/241.6, 242.6, 213; 175/325.1, 325.5, 175/325.6

See application file for complete search history.

(56) References Cited

U.S. PATENT DOCUMENTS

| | | | | | |
|---|---|---|---|---|---|
| 1,201,706 | A | * | 10/1916 | Dodge | 403/344 |
| 2,797,756 | A | * | 7/1957 | Hall, Sr. | 166/173 |
| 2,824,613 | A | * | 2/1958 | Baker et al. | 166/241.7 |
| 2,855,002 | A | | 10/1958 | Schiller | |
| 2,855,052 | A | * | 10/1958 | Wright et al. | 166/243 |
| 3,040,405 | A | * | 6/1962 | Solum | 24/114.5 |
| 3,108,639 | A | * | 10/1963 | Brooks | 166/241.7 |
| 3,593,390 | A | * | 7/1971 | Pettigrew | 24/526 |
| 5,706,894 | A | | 1/1998 | Hawkins, III | |
| 5,860,760 | A | * | 1/1999 | Kirk | 403/371 |
| 6,453,998 | B1 | * | 9/2002 | Reeve | 166/241.1 |
| 6,957,704 | B2 | * | 10/2005 | Rogers et al. | 166/378 |
| 7,104,318 | B2 | * | 9/2006 | Hendrie | 166/241.1 |

* cited by examiner

*Primary Examiner* — Giovanna Wright
(74) *Attorney, Agent, or Firm* — Bracewell & Giuliani, LLP

(57) ABSTRACT

A stop collar assembly used for axially securing and/or to resist axial sliding of a downhole tool device. The assembly provided on a housing of the downhole tool and includes a generally annular ring having an inner circumference beveled outward proximate to the ring edge. A clamp ring having a raised portion on its outer surface is disposed adjacent and substantially coaxial with the annular ring. Pushing the annular ring against the clamp ring compresses the clamp ring onto the housing to resist axial sliding of the annular ring.

13 Claims, 2 Drawing Sheets

STOP COLLAR FRICTION CLAMPING DEVICE

CROSS REFERENCE TO RELATED APPLICATIONS

This application claims priority to and the benefit of U.S. Provisional Application Ser. No. 61/044,559, filed Apr. 14, 2008, the full disclosure of which is hereby incorporated by reference herein.

FIELD OF INVENTION

The invention relates generally to the field of oil and gas production. More specifically, the present disclosure relates to a device and method for affixing together members to be disposed downhole with two or more opposing wedge like members.

BRIEF DESCRIPTION OF DRAWINGS

Some of the features and benefits of the present invention having been stated, others will become apparent as the description proceeds when taken in conjunction with the accompanying drawings, in which.

Figure 1:
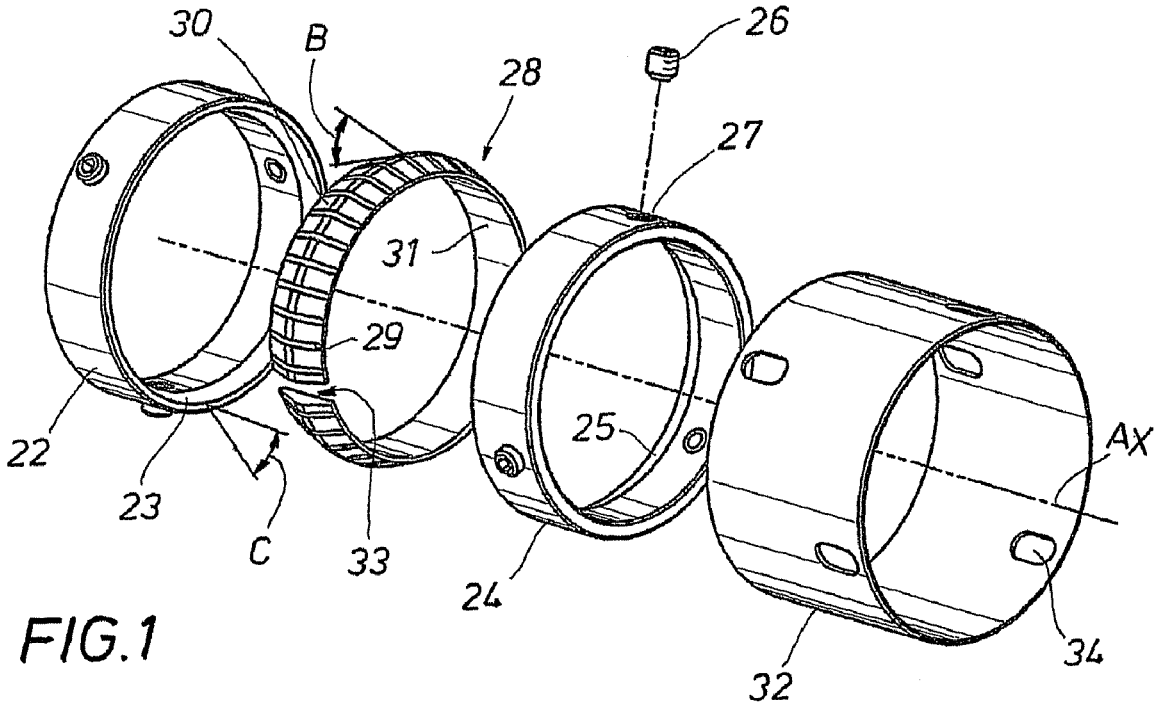
FIG. 1 illustrates an exploded perspective view of an embodiment of a stop collar assembly.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout. For the convenience in referring to the accompanying figures, directional terms are used for reference and illustration only. For example, the directional terms such as "upper", "lower", "above", "below", and the like are being used to illustrate a relational location.

It is to be understood that the invention is not limited to the exact details of construction, operation, exact materials, or embodiments shown and described, as modifications and equivalents will be apparent to one skilled in the art. In the drawings and specification, there have been disclosed illustrative embodiments of the invention and, although specific terms are employed, they are used in a generic and descriptive sense only and not for the purpose of limitation. Accordingly, the invention is therefore to be limited only by the scope of the appended claims.

FIG. 1 provides an exploded view of one example of a stop collar assembly 20 in accordance with the present disclosure. The stop collar assembly 20 comprises annular rings 22, 24 having beveled surfaces 23, 25 on their inner diameters. The beveled surfaces 23, 25 lie at an angle C with respect to the annular rings 22, 24 axis $A_X$. The annular rings 22, 24 also include apertures or passages 27 radially formed therethrough. The passages 27 may be threaded and sized to receive set screws 26 within the passages 27. Adjacent the annular rings 22, 24 is a gripping wedge ring 28, shown in this embodiment as having a split section 33. The gripping wedge ring 28 outer surface includes a ridge at about its mid-section and is profiled away from the ridge at an angle B. Angle B and angle C can be substantially equal or at different values. The ring inner surface 31 may optionally be textured to increase its coefficient of friction. Shown adjacent the ring 24 is an optional sleeve 32 for housing the rings 22, 24. The sleeve 32 is provided with elongated slots 34 so the set screws 26 can be externally accessed.

Figure 2:
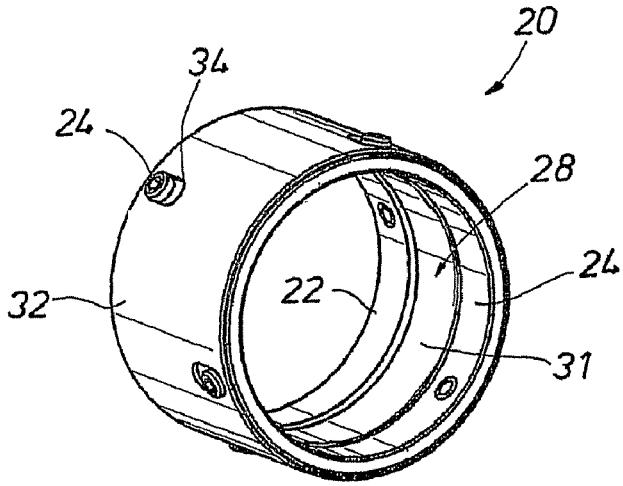
FIG. 2 is a perspective view of an assembled embodiment of the assembly of FIG. 1.

FIG. 2 provides a perspective view of an assembled embodiment of the stop collar assembly 20. In FIG. 2 the gripping wedge ring 28 resides coaxially within the sleeve 32 and stacked between the annular stop rings 22, 24 on opposite sides of the wedge ring 28. Set screws 26 extend through the slots 34 and into the passages 27. The slot 34 is elongated along the axial direction of the sleeve 32 thereby allowing the set screw 26 to laterally move within the sleeve 32 body.

Figure 3:
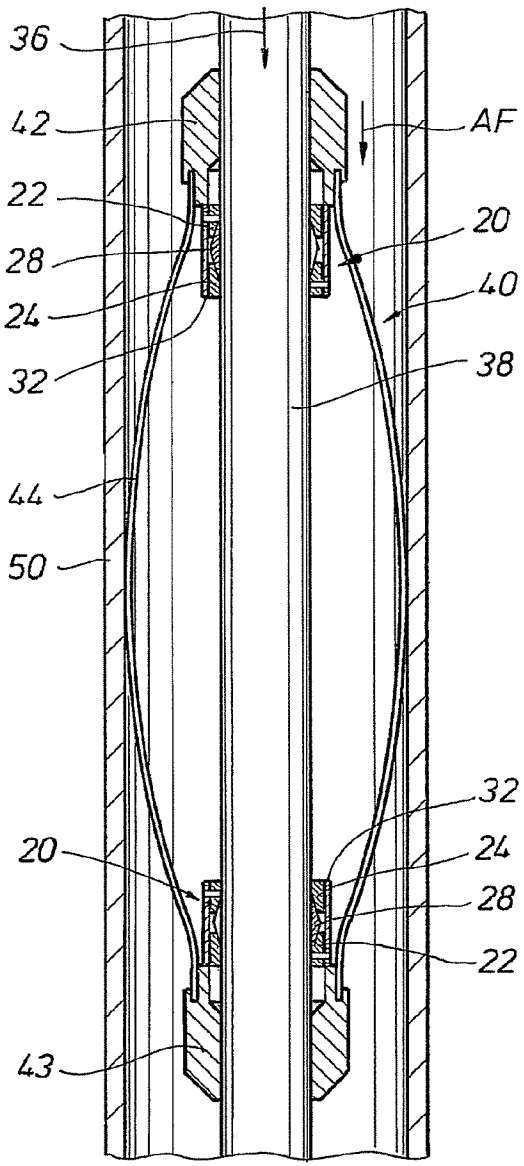
FIG. 3 depicts a side view of an embodiment of a stop collar assembly of FIG. 1 on a downhole tool.

FIG. 3 is a side view of a downhole tool 36 employing a centralizer 40 combined with a stop collar assembly 20. The centralizer 40 comprises a pair of circular base members 42, 43 around the downhole tool 36 housing 38. Centralizer arms 44 pivotingly attach on one end to a first base member 42 and on the other end of the arm 44 to the second base member 43. As is known, the arms 44 bow out in their midsection into contacting engagement with the inner circumference of a tubular 50, such as casing or other downhole tubing. The centralizer 40 maintains the downhole tool 36 a set distance from the walls of the tubular 50. When the tool 36 is stationary in the tubular 50, the tubular 50 walls exert a radially inward force on the arms 44 resulting in opposing lateral forces pushing the base members 42, 43 apart. When the tool 36 is being pushed into the tubular 50 its walls tangentially rub against the arms 44 urging the centralizer 40 upward on the tool 36. This loads the base member 43 against the lower stop collar 20. Similarly, when pulling the tool 36 from within the tubular 50, the arms 44 rub against the tubular 50 walls resulting in the base member 42 transferring the arm 44 and tubular 50 wall frictional force against the upper stop collar 20.

In the example of use depicted in FIG. 3, the transferred frictional force between the arms 44 and tubing 50 wall (as illustrated by arrow AF) pushes the anchor 43 against the stop collar assembly 20. The centralizer anchor 43 is in contact with the annular ring 22 of the collar assembly 20. The set screws 26 are illustrated tightened through the annular ring 22 and against the housing 38 outer surface to provide sufficient anchoring force for the ring 22 onto the housing 38. However, in some situations, the force AF may exceed the compression and friction forces of the set screws 26 on the housing 38 and may axially move the annular rings 22 toward the adjacent gripping wedge ring 28. This further engages the beveled surface 23 against the wedge ring's 28 profile thereby further compressing the wedge ring 28 against the housing 38. Further engaging the beveled surface 23 over the wedge ring 28 profile correspondingly increases the compression force applied to the housing 38 by the wedge ring 28. Ultimately, the compressive force exceeds the axial force AF thereby preventing further lateral movement of the annular ring 22 securing the centralizer anchor 43 in place. The values of angles B and C may be selectable to produce a desired clamping force. It is within the capabilities of those skilled in the art to determine angle values to produce a particular clamping force.

Example 1

Figure 4:
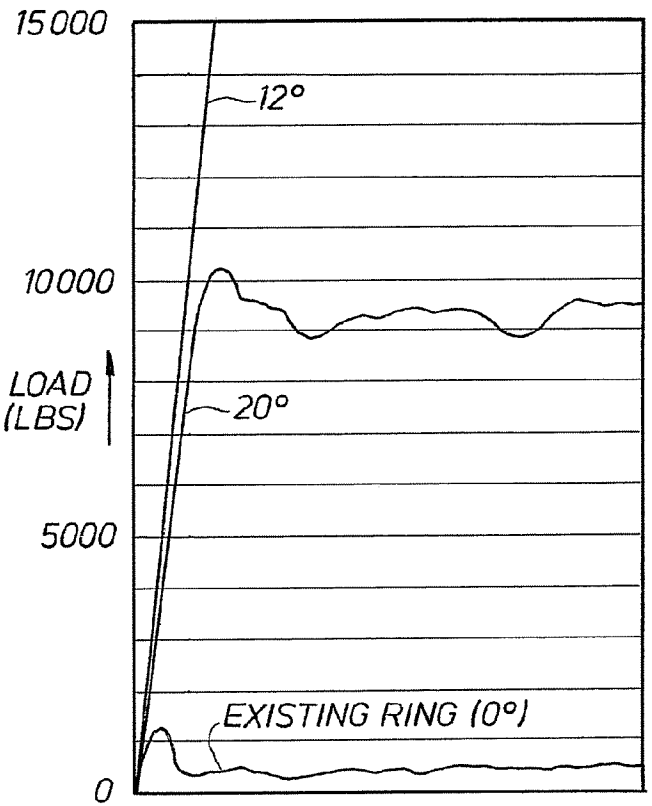
FIG. 4 is a plot of load test results for a prior art stop ring and stop collars with different beveled edges.

In one actual example of use, the stop collar assembly 20 has been measured to provide a multiple of seven to ten times the gripping force of traditional known stop rings under static loads and up to twenty times the kinetic gripping force. FIG. 4 includes plots of actual applied axial pounds force (ordinate) onto a stop ring over time (abscissa). The plots represent test data for: (1) a prior art existing ring; (2) a stop ring as described herein with angles B and C equal to about 20°; and (3) a stop ring as described herein with angles B and C equal to about 12°. The rings 22, 24, 28 were coupled to a test mandrel and an increasing axial load was applied. Where a local maximum occurs for the applied load indicates the particular ring was moved from its mounting by the applied load. The test results indicated that the existing ring supported an axial load up to about 1200 lbs before releasing. The stop ring beveled at 20° withstood loads in excess of 10,000 lbs and the stop ring beveled at 12° remained stable up to the test device maximum applied load of 15,000 lbs. Accordingly, stop rings beveled at more acute angles can withstand higher applied axial loads.

Alternative values for the angles B and C include angles up to or greater than about 7°, up to or greater than about 8°, up to or greater than about 9°, up to or greater than about 10°, up to or greater than about 11°, up to or greater than about 12°, up to or greater than about 13°, up to or greater than about 14°, up to or greater than about 15°, up to or greater than 16°, up to or greater than about 17°, up to or greater than about 18°, up to or greater than about 19°, up to or greater than about 20°, up to or greater than about 21°, and up to or greater than about 22°. Additionally, the present disclosure includes stop collar assembly 20 embodiments that are not self locking. That is, the angles B and C are such that when applied axial loads are removed from the stop collar assembly 20, the rings 22, 24, 28 have not become press fit together, but instead can be readily separated. Angles B and C that form a "self locking" configuration depend on the ring 22, 24, 28 material and application.

The centralizer 40 is but one example of a piece of auxiliary equipment on a downhole tool 36 that may be secured with the stop collar assembly 20 as disclosed herein. The stop collar assembly 20 is also useful for any other auxiliary device slideable under an axial load that may be attached to or used with a downhole tool. Other examples include a standoff type centralizer, a de-centralizer, an excluder, or a wedge coaxially disposed on the outer surface of a downhole tool for mating with slips that slide along a tool body.

Optionally, the downhole tool may employ more than one stop collar assembly 20 and may be on opposite ends of the devices such as the centralizer 40. Other embodiments include a single wedge ring combined with a single annular ring. In such embodiment, the wedge ring may have an anchoring means to hinder axial movement, such as a set screw thereby negating the need for the second annular ring.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the wedge ring 28 could be integrally included within the remaining portions of the assembly 20 and not as a separate member. These and other similar modifications will readily suggest themselves to those skilled in the art, and are intended to be encompassed within the spirit of the present invention disclosed herein and the scope of the appended claims.

What is claimed is:

1. A clamping assembly for use in a downhole tool comprising:

an annular wedge ring engagable with the tool and circumscribing a portion of the tool;

an outer radial surface on the wedge ring having a raised mid portion that defines a ridge and that is profiled radially inward at an angle B from the mid portion to opposing lateral ends of the wedge ring thereby providing a triangular shaped cross section in the wedge ring; and an annular stop ring circumscribing a portion of the tool adjacent the wedge ring and having a bevel on an inner surface of the stop ring that projects radially outward at an angle C along a lateral end of the stop ring and adjacent the wedge ring, so that when a base mount of an attachment to the downhole tool is axially urged against the bevel on the annular stop ring axially slides along the outer radial surface on the wedge ring towards the ridge to compressively couple the wedge ring to the downhole tool.

2. The clamping assembly of claim 1, wherein angles B and C range from about 8° to about 25°.

3. The clamping assembly of claim 1, wherein the stop ring comprises a first stop ring, the clamping assembly further comprising a second stop ring on a side of the wedge ring opposite the first stop ring circumscribing a portion of the tool adjacent the wedge ring and having a bevel on an inner surface of the stop ring that projects radially outward at an angle C along a lateral end of the second stop ring and adjacent the wedge ring, so that when a base mount of an attachment to the downhole tool is axially urged against the bevel, the second stop ring axially slides along the outer radial surface on the wedge ring towards the ridge to compressively couple the wedge ring to the downhole tool.

4. The clamping assembly of claim 3, further comprising a sleeve engagable with and circumscribing the first and second stop rings, passages formed through a side wall of the sleeve that register with passages in the side walls of the first and second stop rings, wherein the passages extend an axial distance along the sleeve that corresponds to an expected distance of axial movement of the first and second stop rings.

5. The clamping assembly of claim 1, further comprising threaded passages radially formed through a side wall of the stop ring and set screws threadingly engaged with the threaded passages thereby coupling the stop ring to the downhole tool.

6. The clamping assembly of claim 1, wherein the wedge ring is a single continuous member having a split along a portion of the circumference of the wedge ring so that the wedge ring is radially deformable.

7. A downhole tool disposable in a wellbore tubular comprising:

a mandrel having an axis;

a centralizer comprising:

first and second base members circumscribing the mandrel disposed axially apart; and arms having first and second ends respectively coupled with the first and second base members and mid portions bowing radially outward from the mandrel;

first and second stop collar assemblies engageable to the mandrel and respectively adjacent the first and second base members, each stop collar assembly comprising:

a stop ring engaged with a wedge ring along an interface that is angled along a line extending from the axis to an outer circumference of a mid-portion of the wedge ring, so that a lateral force pushing the stop ring towards the wedge ring mid portion compressively couples the wedge ring to the mandrel;

a ridge on the mid portion of the outer circumference of the wedge ring so that the wedge ring has a substantially triangular cross section and bevels on a lateral end of each stop ring adjacent the wedge ring and an interface defined by contact between the bevel and a profile formed by the ridge.

8. The downhole tool of claim 7, further comprising a second stop ring on a side of the wedge ring opposite the stop ring, the second stop ring engaged with the wedge ring along an interface formed by a beveled surface circumscribing the second stop ring inner circumference between its mid portion and lateral side where it contacts the wedge ring.

9. The downhole tool of claim 8, further comprising an angled surface on the wedge ring outer circumference between the wedge ring mid portion and its lateral side adjacent the second stop ring.

10. The downhole tool of claim 8, further comprising an annular sleeve circumscribing the rings and coupled to the stop rings.

11. The downhole tool of claim 10, further comprising bores formed through the stop ring and fasteners in the bores engaged with the mandrel.

12. The downhole tool of claim 7, wherein the interface angle ranges from about 8° to about 25° with respect to the axis.

13. The downhole tool of claim 7, wherein the first and second stop collar assemblies are between the first and second base members.

* * * * *